US005533684A

United States Patent [19]

Bielagus

[11] Patent Number: 5,533,684

[45] Date of Patent: Jul. 9, 1996

[54] WOOD CHIP STRAND SPLITTER

[75] Inventor: Joseph B. Bielagus, Tualatin, Oreg.

[73] Assignee: Beloit Technologies, Inc., Wilmington, Del.

[21] Appl. No.: 323,553

[22] Filed: Oct. 17, 1994

[51] Int. Cl.[6] ..... B02C 1/08; B02C 7/04; B27C 1/00

[52] U.S. Cl. ..... 241/222; 144/173; 144/362; 144/246.1; 144/162.1; 241/223; 241/236

[58] Field of Search ..... 144/2 R, 2 P, 49, 144/162 R, 164, 173, 242 R, 361, 362; 198/382, 752; 241/186.4, 220, 222, 223, 228, 236, 227, 282.1

[56] References Cited

U.S. PATENT DOCUMENTS

| | | | |
|---|---|---|---|
| 1,867 | 11/1840 | Winans | 144/173 |
| 5,590 | 5/1848 | Hancock | 144/173 |
| 19,971 | 4/1858 | Wheeler | 144/173 |
| 336,424 | 2/1886 | Norris et al. | 144/173 |
| 609,114 | 8/1898 | Munday | 144/173 |
| 2,360,729 | 10/1944 | Spang | 241/236 |
| 2,717,012 | 9/1955 | Schneider | 144/162 R |
| 3,044,510 | 7/1962 | Schneider et al. | 144/162 R |
| 3,860,180 | 1/1975 | Goldhammer | 241/236 |
| 5,161,591 | 11/1992 | Sealey et al. | 144/362 |
| 5,199,474 | 4/1993 | Hoben | 144/362 |

*Primary Examiner*—W. Donald Bray
*Attorney, Agent, or Firm*—Dirk J. Veneman; Raymond W. Campbell

[57] ABSTRACT

Two rolls are mounted to a frame and rotated about spaced parallel axes by electric motors operating through speed reducers. Each roll has a surface formed of uniformly spaced, circumferential extending triangular grooves and ridges defined between grooves. The ridges of one roll are closely spaced from the grooves of the other roll to define a sinuous nip therebetween. A vibrating conveyor orients wood strands and feeds the strands to the nip with the grain of the strands parallel to the roll ridges and grooves. Wood chips have low strength transverse to the direction of the grain and, thus, when forced to flex by the interdigitating ridges and grooves of the opposed rolls, split into narrower strands.

4 Claims, 3 Drawing Sheets

WOOD CHIP STRAND SPLITTER

FIELD OF THE INVENTION

The present invention relates in general to methods and apparatuses for processing chip-like or wafer-like materials, and relates in particular to methods and apparatuses for processing jumbo wood chips or wafers.

BACKGROUND OF THE INVENTION

Wood is a naturally occurring composite material being made of wood fibers embedded in a matrix of lignin. Thus lumber made from harvested wood has strength properties which are dependent on the orientation of the fibers or wood grain. Recently the convergence of two trends in the development of wood products has led to the development of new engineered wood-based structural members. The first trend is the increasing costs of wood due to increased demand and decreased supply due to environmental restrictions on logging. In the past, wood unsuitable for forming dimensional timber was often discarded or burnt as waste fuel. Now, however, scrap wood is reduced to wood chips for use in papermaking, particle board or engineered structural members. The second trend is the result of an insight from the structural composites industry marking the realization that composite materials may be engineered to suit particular applications. The result has been products such as wafer board or chip board which have randomly oriented chips or wafers of wood which are laminated together to form a plywood replacement product which is not only cheaper but stronger than plywood in many applications.

Structural timbers are composed of wood chips in which the chip fibers are oriented in the direction of the principle stresses. The wood chips are laminated under heat and pressure to form large laminated loaves which are in turn milled into structural members. The process allows the fabrication of wood structural members which do not require large or uniform logs as starting materials. Further, because the structural properties of the member may be designed, the beam may be stronger and lighter than one constructed of wood boards.

The wood chips or wafers utilized in the construction of these new wood products are fabricated from a wide range of raw logs and wood scraps. Typically the wafers are forty to sixty thousandths of an inch thick, four to twelve inches long, and one-half to three inches wide. In the production of strand board in particular, and structurally engineered wood products in general, it is desirable that the strands not be too wide. This allows better control of the orientation of the strands to achieve the structural properties desired, particularly the random orientation of the strand layers in strand board.

Wafers of uniform width also improve the overall appearance of the product by yielding a uniform surface and by facilitating improved uniformity of the glue coating on the wafers. Slicing the wafers into wafers of proper width presents several problems. The wafers must be precisely oriented as they are fed into the knives to prevent the knives from cutting across the grain and so cutting the fibers in the wafers. It is also desireable to minimize the fines produced by cutting the wafers, as small particles are unacceptable for use in the formation of wafer board.

What is needed is a process and apparatus for splitting strand boards into narrow, uniform lengths without the destruction of useful fiber.

SUMMARY OF THE INVENTION

The strand splitter of this invention employs a pair of opposed rolls. The surface of each roll is formed of uniformly spaced, circumferential triangular grooves with triangular ridges defined between adjacent grooves. The ridges of one roll are closely spaced, about an eight of an inch, from the grooves of the opposed roll, thereby forming a sinuous nip between the rolls. The rolls are mounted on a frame and driven to rotate about spaced parallel axes by electric motors operating through speed reducers. Wood chips strands or wafers are fed to the nip from a vibrating conveyor which orients the strands so they enter the rolls with the grain of the strands parallel to the ridges and grooves on the rolls. The infed wood chips, which are forty to sixty thousandths of an inch thick, have low strength transverse to the direction of the grain and, thus, when forced to flex by the interdigitating ridges and grooves of the opposed rolls, are split into strands which have a width less than or equal to the length of a groove side plus the width of the gap between rolls.

It is a feature of the present invention to provide a wood chip strand splitter which retains fiber integrity.

It is another feature of the present invention to provide a wood chip strand splitter which reduces the generation of fines.

It is a further feature of the present invention to provide a wood chip strand splitter which cracks an infed wafer along the fiber length.

It is a still further feature of the present invention to facilitate the production of strand board by reducing the cost of the strands comprising it.

Further objects, features and advantages of the invention will be apparent from the following detailed description when taken in conjunction with the accompanying drawings.

DESCRIPTION OF THE PREFERRED EMBODIMENTS

Figure 1:
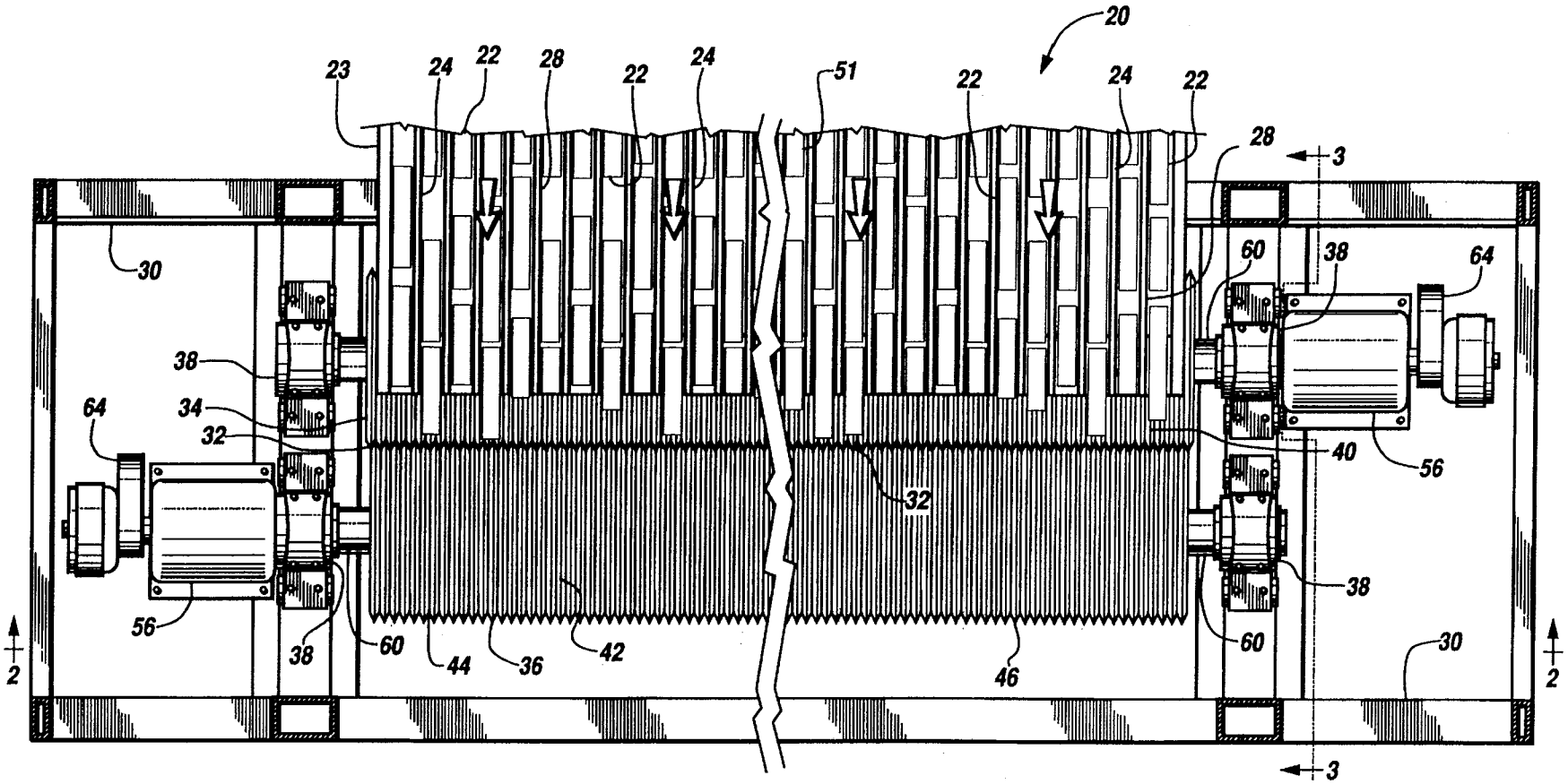
FIG. 1 is a top plan view of the wood chip strand splitter of this invention.
Figure 2:
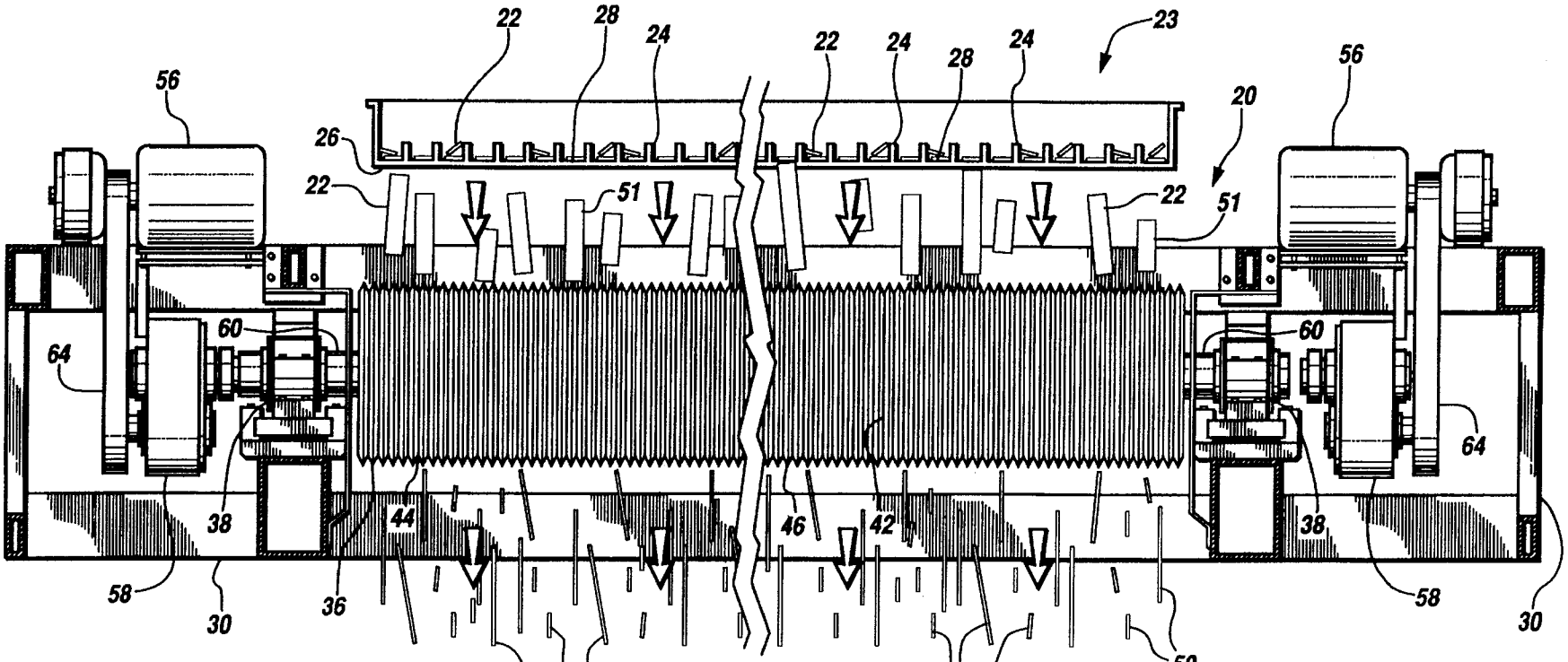
FIG. 2 is a cross-sectional view of the wood chip strand splitter of FIG. 1 taken along section line 2—2.
Figure 3:
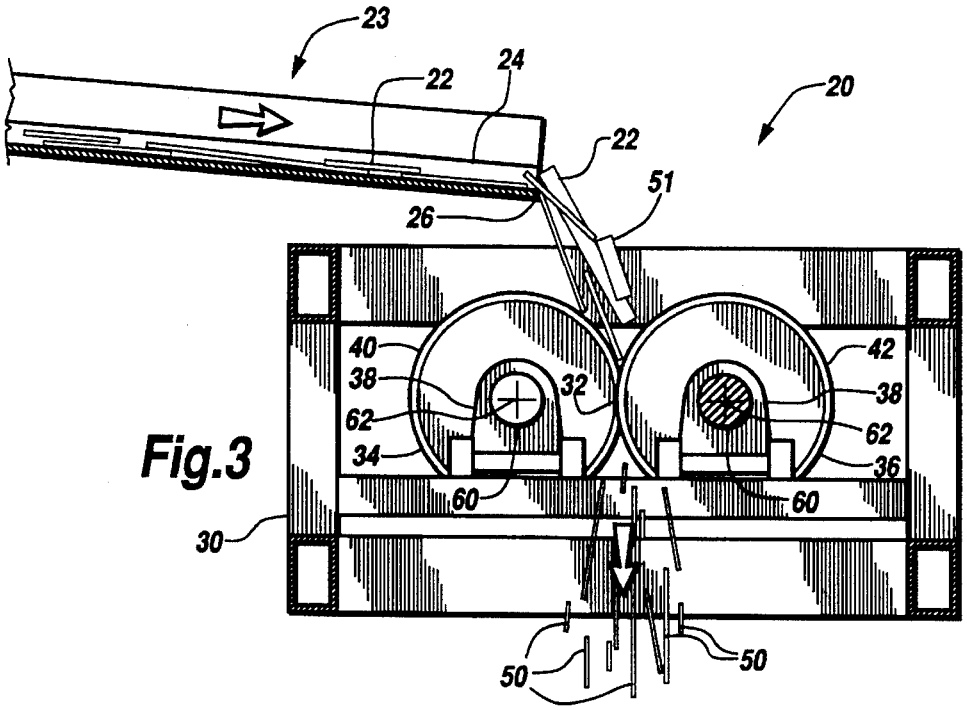
FIG. 3 is an cross-sectional view of the strand splitter of FIG. 1 taken along section line 3—3.

Referring more particularly to FIGS. 1–5, wherein like numbers refer to similar parts, a wood chip strand splitter 20 is shown in FIGS. 1–3. As shown in FIG. 1, wooden strands 22 are introduced to the splitter 20 by a vibrating conveyor 23. The strands 22, also known as wafers or jumbo wood chips, have their largest dimension, their length, along the grain of the wood chip 22. The chip length typically varies between four and twelve inches. The wood chips 22 are typically forty to sixty thousandths of an inch thick and one to three inches wide.

As shown in FIGS. 1 and 2, the vibrating conveyor 23 has upstanding vertical ribs 24. The ribs 24 are spaced apart to form troughs 28 approximately three inches wide. The vibration of the conveyor 23 not only progresses the chips 22 toward the conveyor discharge edge 26 but also causes the chips to align and fall within the troughs 28 between the ribs 24. The overall effect of the vibrating conveyor 23 is to spread out and feed the wood chips 24 with the grain aligned along the direction of movement. A scraper or brush (not shown) can be positioned over the vibrating conveyor to prevent any wood chips which have not fallen into a trough 28 from progressing to the conveyor discharge edge 26. The conveyor 23 is mounted above the frame 30 of the strand splitter 20. The chips 22 discharged from the conveyor 23 are fed into a sinuous nip 32 formed between a first roll 34 and a second roll 36 which are mounted to the frame 30 for rotation on bearings 38.

Figure 4:
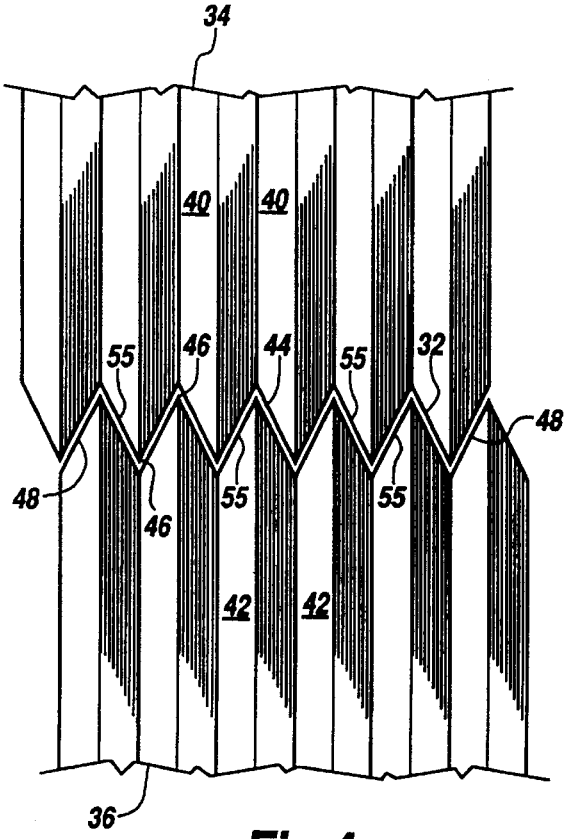
FIG. 4 is an enlarged fragmentary plan view of the intermeshing rolls of the strand splitter of FIG. 1.

The rolls 34, 36 are generally cylindrical. An exemplary roll is ten feet long and approximately eleven inches in diameter. The surfaces 40, 42 of the rolls 34, 36 are contoured with parallel spaced circumferential grooves 44. Circumferential ridges 46 are defined between adjacent grooves 44. Each groove 44 is defined as the intersection of two frustoconical side surfaces 55. As shown in FIG. 4, the grooves 44 of the first roll 34 interdigitate with the ridges 46 of the second roll 36. The nip 32, shown in FIGS. 1 and 4, is sinuous and snakes back and forth between the opposed ridges and grooves of the first and second rolls 34, 36. The wood strands 22 leave the vibrating conveyor 23 and free fall into the nip 32 between the rolls 34, 36 as shown in FIGS. 2 and 3. The wood strands 22 enter the nip 32 with their grain oriented in the direction of travel and thus the grain of the strands 22 is substantially tangent to the rolls 34, 36.

As the wood strands 22 pass through the nip 32, they are forced to conform to the sinuous saw-toothed shaped gap 48 of the nip 32. This causes the strands 22 to bend sharply parallel to the grain which fractures the chips into narrow strands 50. The width of the resulting processed strands 50 is dependent on the size of the grooves 44 and the ridges 46. It has been found that a strand splitter having rolls with grooves which are three-quarters of an inch deep and three-quarters of an inch wide will produce processed strands which have a maximum width of approximately one inch. Because the infed wood strands 22 vary in width and because the edges 51 of the infed strands 22 are not precisely aligned with a ridge 46, the groove spacing controls the maximum width of the chip with a size distribution below that maximum width.

In some strand board products it is desirable that the wood strands all have widths less than one inch. A particular configuration of the rolls 34, 36, as shown in FIG.4, has grooves which are three quarters of an inch wide and three quarters of an inch deep, and advantageously achieves this desired size distribution.

The size of the processed strands 50 is generally governed by the length of the groove sides 55 together and by the width of the gap between rolls which is preferably approximately one-eighth of an inch flat to flat.

The rolls are driven by motors 56 through speed reducers 58. The speed reducers 58 are mounted on the roll shafts 60 which define axes 62 about which the shafts rotate. The motors are connected by V-belts 64 to the speed reducers 58 which drive the shafts to cause the rolls to counter-rotate and draw the infed wood strands 22 through the nip 32. The wood chips 22 have dimensions of length, width and thickness. The wood fibers are rod-like structures which extend along the length. The strands 22 are resistant to breaking if bent across the length because the fibers traverse the length. On the other hand, because few or no fibers traverse the width, if bent across the width, the wood strands 22 readily break. The wood chips 22 are composites of wood fibers in a matrix of lignin and if broken crosswise, the fracture takes place in the lignin and thus the individual fibers are not damaged.

Conventionally, wood strands are sliced by blades to the proper width. Slicing presents several problems which are overcome by the strand splitter 20. Blades wear and must be sharpened and further can be subject to rapid wear by grit or dirt carried along by the wood strands. Another disadvantage of slicing blades is that because wood grain is not perfectly straight, and because the strands are not perfectly aligned with a slicer's blades, wood fibers are cut in the slicing operation. The slicing operation can produce fines which become waste. The overall strength of a strand is decreased by the slicer cutting across the strand grain.

The strand splitter 20 of this invention, on the other hand, by breaking the chips along the grain, allows the break line to follow the grain of the wood. Thus, the strands 22 are broken along the grain into smaller strands, not cut, thus avoiding the breaking of any fibers. This breaking along the grain maximizes the utilization of the fibers and the strength of the strands. The grooves and ridges formed on the roll have rounded edges, for example a radius of 0.032 for the tops of the ridges and bottom of the grooves. Thus the strand splitter 20 has no sharp edges and so significantly less maintenance is required than in a slicer.

Figure 5:
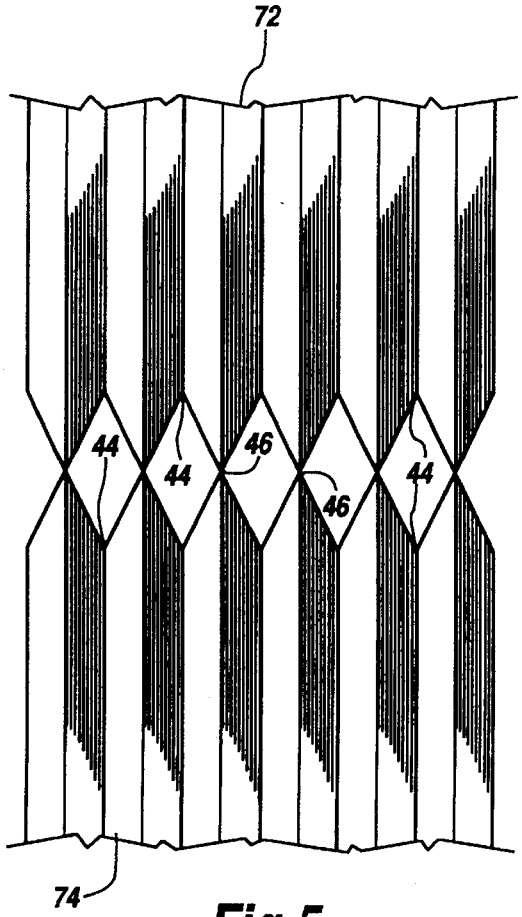
FIG. 5 is an enlarged fragmentary plan view of the intermeshed rolls of an alternative embodiment strand splitter of this invention which run tip to tip.

Although in the preferred embodiment, the ridges of the rolls 34, 36 interdigitate, as shown in FIG. 5, alternative rolls 72, 74 may run with the ridges peak to peak. When the ridges are run opposed, the tips of the ridges engage so that the fracturing takes place between the tips of the ridges which induce a compressive fracture in the strands 22. The maximum width of the strands formed by the grooved rolls of FIG. 5 is governed by the tip spacing of the ridges, in contrast to the rolls in FIG. 4 where the maximum length is governed by the length of the side of the groove between the ridge tip and groove bottom.

It should be understood that wherein grooves of varying widths could be employed, grooves having widths of one-half to three-quarters of an inch have particular utility in forming chips of a preferred size distribution for strand board construction.

It should be further understood that in place of a vibrating conveyor for aligning and feeding the chips, orientation rolls which use discs, or other similar devices could be used.

It should also be understood that the, grooved rolls may be formed of nickel-plated cast iron. Rolls also may be formed with an outer layer of high durometer plastic so that tramp materials will not damage them as they transit the nip 32.

It is understood that the invention is not limited to the particular construction and arrangement of parts herein illustrated and described, but embraces such modified forms thereof as come within the scope of the following claims.

I claim:

1. An apparatus for splitting wood chips comprising:

a frame;

a first cylindrical roll rotatively mounted to the frame, wherein portions of the first roll define a plurality of axially spaced circumferentially extending grooves, and wherein adjacent grooves define radially protruding ridges; and a second cylindrical roll rotatively mounted to the frame, wherein portions of the second roll define a plurality of axially spaced circumferentially extending grooves, and wherein adjacent grooves define radially protruding ridges, and wherein the second roll is mounted in spaced parallel relation to the first roll such that the ridges of the first roll interdigitate with the ridges of the second roll so that the ridges of the first roll are closely spaced from the grooves of the second roll but do not touch, and the ridges of the second roll are closely spaced from the grooves of the first roll but do not touch, such that rotation of the first roll and second roll toward one another causes the splitting without slicing of infed wood chips having substantially aligned wood grain.

2. The apparatus of claim 1 wherein the ridge to ridge width of each groove is between 0.5 inches and 0.75 inches.

3. The apparatus of claim 1 further comprising a vibrating conveyor positioned above the two roles, wherein woods chips are vibrated on the conveyor and aligned prior to being discharged into the rotating rolls.

4. A method for splitting wood strands comprising the steps of:

orienting wood strands having direction of wood grain so the strands are aligned in the direction of wood grain, and advancing the aligned wood strands in the direction of the wood grain;

feeding the strands of wood in the wood grain direction into a gap defined between interdigitating spaced grooved rolls; and rotating opposed grooved rolls to break the infed strands along their grain by forcing them to conform to a sinuous gap between the rolls.

* * * * *